US006830368B2

(12) United States Patent
Fukano

(10) Patent No.: US 6,830,368 B2
(45) Date of Patent: Dec. 14, 2004

(54) MIXING VALVE WITH AGITATION CHAMBER AND HELICAL FLUID SUPPLY PASSAGES

(75) Inventor: Yoshihiro Fukano, Moriya (JP)

(73) Assignee: SMC Kabushiki Kaisha, Tokyo (JP)

( * ) Notice: Subject to any disclaimer, the term of this patent is extended or adjusted under 35 U.S.C. 154(b) by 52 days.

(21) Appl. No.: 10/214,610

(22) Filed: Aug. 9, 2002

(65) Prior Publication Data

US 2003/0031087 A1 Feb. 13, 2003

(30) Foreign Application Priority Data

Aug. 10, 2001 (JP) ..... 2001-244043

(51) Int. Cl.[7] ..... B01F 5/04

(52) U.S. Cl. ..... 366/173.1; 366/175.2

(58) Field of Search ..... 366/165.1–165.5, 366/160.1, 162.1, 162.4, 167.1, 173.1, 173.2, 174.1, 175.2, 176.1, 176.2, 181.5, 338–339, 182.4; 251/331

(56) References Cited

U.S. PATENT DOCUMENTS

| | | | | | |
|---|---|---|---|---|---|
| 2,000,953 | A | * | 5/1935 | Hooker et al. | 366/339 |
| 2,652,234 | A | * | 9/1953 | Feldmanm | 366/339 |
| 2,784,948 | A | * | 3/1957 | Pahl et al. | 366/174.1 |
| 2,817,500 | A | * | 12/1957 | Robinson | 241/33 |
| 2,831,754 | A | * | 4/1958 | Manka | 423/658.5 |
| 3,286,992 | A | | 11/1966 | Armeniades et al. | |
| 3,709,468 | A | * | 1/1973 | Ives | 366/339 |
| 3,999,740 | A | * | 12/1976 | McCorvey | 366/159.1 |
| 4,070,008 | A | * | 1/1978 | Schlieckmann | 366/159.1 |
| 4,117,551 | A | * | 9/1978 | Brooks et al. | 366/162.1 |
| 4,168,018 | A | * | 9/1979 | Zahaykevich | 222/82 |
| 4,270,576 | A | * | 6/1981 | Takeda et al. | 137/888 |
| 4,537,513 | A | * | 8/1985 | Flesher et al. | 366/162.1 |
| 4,778,659 | A | * | 10/1988 | Inoue | 422/135 |
| 5,377,956 | A | * | 1/1995 | Muller | 251/331 |
| 5,549,134 | A | | 8/1996 | Browne et al. | |
| 5,806,976 | A | * | 9/1998 | Roque | 366/338 |
| 6,227,699 | B1 | * | 5/2001 | Wight, Jr. | 366/336 |
| 2003/0031087 | A1 | * | 2/2003 | Fukano | 366/173.1 |

FOREIGN PATENT DOCUMENTS

| | | | |
|---|---|---|---|
| DE | 15 57 118 C1 | | 9/1981 |
| DE | 43 02 661 A1 | | 8/1994 |
| DE | 39 40 035 C2 | | 3/1999 |
| GB | 2271725 | * | 4/1994 |
| JP | 56-89823 | | 7/1981 |

* cited by examiner

*Primary Examiner*—Charles E. Cooley
(74) *Attorney, Agent, or Firm*—Paul A. Guss

(57) ABSTRACT

A mixing valve comprises a valve body and a plurality of helical members. An agitation chamber is formed in the valve body. The plurality of helical members are disposed substantially in parallel in the valve body and have a number corresponding to a number of fluid supply ports. The plurality of helical members have helical passages on their outer circumferential surfaces and have ends facing the agitation chamber. Fluids are supplied from the fluid supply ports and pass through the helical passages.

31 Claims, 9 Drawing Sheets

MIXING VALVE WITH AGITATION CHAMBER AND HELICAL FLUID SUPPLY PASSAGES

BACKGROUND OF THE INVENTION

1. Field of the Invention

The present invention relates to a mixing valve which mixes fluids supplied from respective ports.

2. Description of the Related Art

A mixing valve has been used to mix fluids supplied from respective ports for obtaining a mixture having a desired composition.

As shown in FIGS. 8 and 9, a conventional mixing valve 1 includes a first port 2*a* supplied with a fluid A and a second port 2*b* supplied with a fluid B in a valve body 3. Further, the valve body 3 has a third port 2*c* discharging a mixed fluid obtained by mixing the fluid A supplied from the first port 2*a* and the fluid B supplied from the second port 2*b*.

A first ON/OFF valve 5*a* and a second ON/OFF valve 5*b* are juxtaposed with each other on the valve body 3. The first ON/OFF valve 5*a* opens/closes a flow passage for the fluid A supplied from the first port 2*a* under the action of a pilot pressure introduced from a first pilot port 4*a*. The second ON/OFF valve 5*b* opens/closes a flow passage for the fluid B supplied from the second port 2*b* under the action of a pilot pressure introduced from a second pilot port 4*b*.

Then, the pilot pressure displaces a first valve plug 6*a* of the first ON/OFF valve 5*a* upwardly to give the valve-open state and displaces a second valve plug 6*b* of the second ON/OFF valve 5*b* upwardly to give the valve-open state. Accordingly, the fluid A supplied from the first port 2*a* and the fluid B supplied from the second port 2*b* are mixed with each other, being discharged from the third port 2*c*.

An agitator 7, which uniformly stirs a mixed fluid discharged from the third port 2*c*, is disposed downstream of the mixing valve 1. The agitator 7 is elongated and kept substantially vertical. The agitator 7 has an inlet port 8*a* at the upper end and an outlet port 8*b* at the lower end. A fluid passage 9 is formed between the inlet port 8*a* and the outlet port 8*b*. The fluid passage 9 functions such that the flow of the mixed fluid supplied from the inlet port 8*a* is continuously reversed in the clockwise direction and the counterclockwise direction to effect the agitation by alternately inverting the twist direction for adjoining cylindrical members.

However, the conventional mixing valve 1 for mixing the fluid A and the fluid B requires the separate agitator 7 for uniformly stirring the mixed fluid, increasing an installation space. The elongated agitator 7 downstream of the mixing valve 1 requires a large vertical space, making it impossible to use the agitator 7 in an installation environment in which the vertical space is narrow.

Further, in the conventional mixing valve 1, the fluid A and the fluid B which are supplied are merely mixed with each other, making it impossible to uniformly mix the fluid A and the fluid B.

SUMMARY OF THE INVENTION

It is a general object of the present invention to provide a mixing valve which reduces an installation space, thereby enabling a space to be effectively used.

A principal object of the present invention is to provide a mixing valve which makes a mixed state of fluids uniform.

According to the present invention, fluids are supplied from respective supply ports and introduced into helical members having ends facing an agitation chamber. The fluids flow helically along helical passages of the helical members into the agitation chamber where the fluids are suitably mixed with each other, enabling the mixed state of the fluids to be uniform.

Further, the present invention does not require any conventional separate agitator downstream of the mixing valve. Therefore, the installation space is narrowed, enabling the space to be effectively used.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
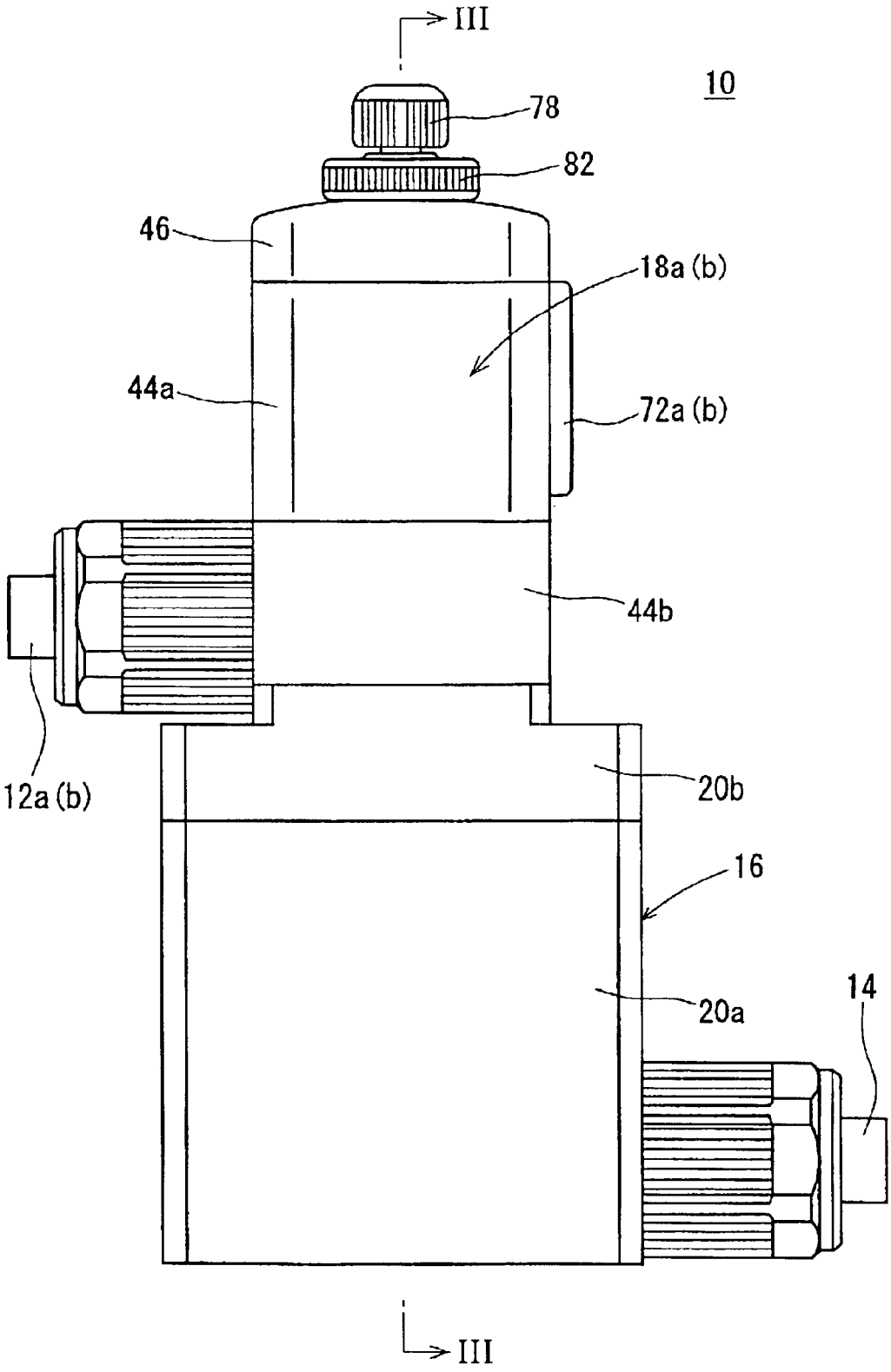
FIG. 1 is a front view illustrating a mixing valve according to an embodiment of the present invention.
Figure 2:
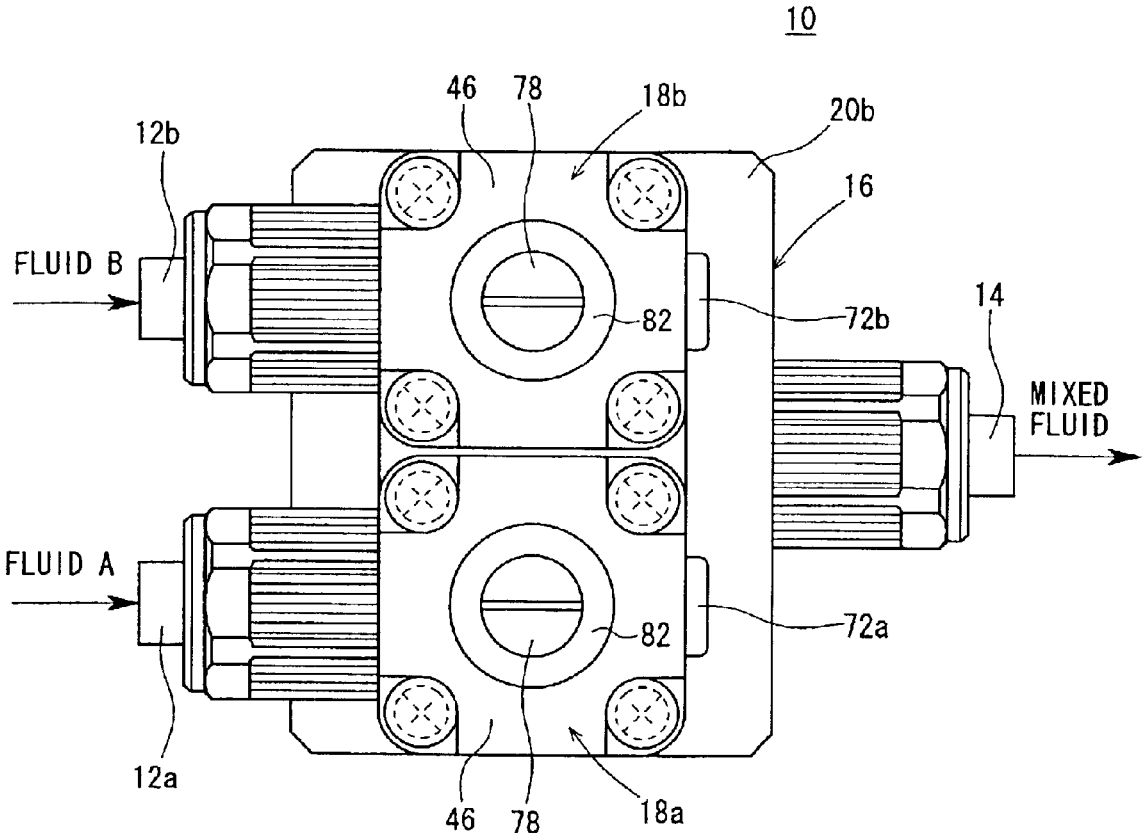
FIG. 2 is a plan view illustrating the mixing valve shown in FIG. 1.
Figure 3:
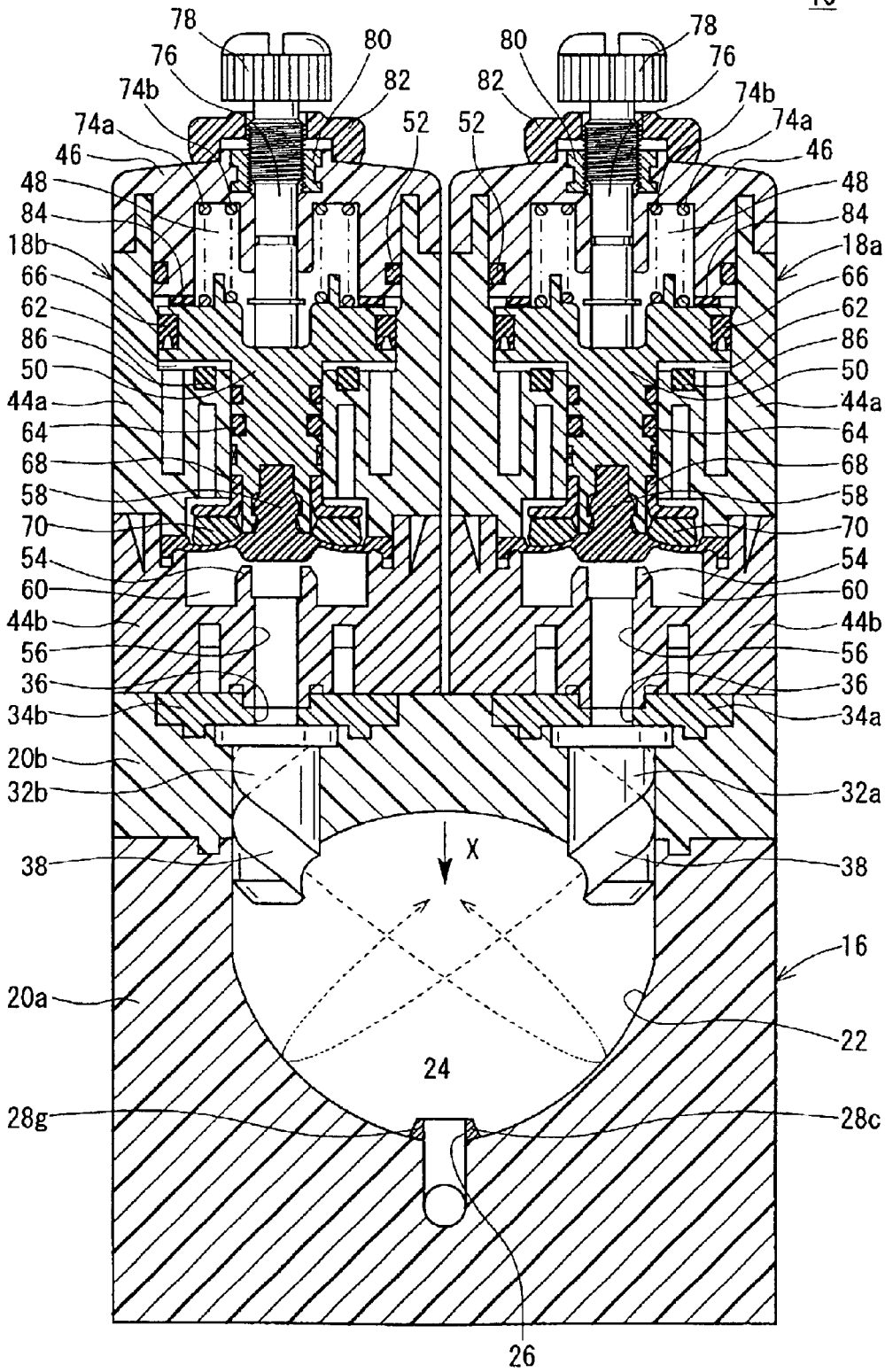
FIG. 3 is a vertical sectional view taken along a line III—III shown in FIG. 1.

In FIGS. 1 to 3, reference numeral 10 denotes a mixing valve according to an embodiment of the present invention.

As shown in FIGS. 1 and 2, the mixing valve 10 comprises a valve body 16, and a first ON/OFF valve section 18*a* and a second ON/OFF valve section 18*b*. The valve body 16 has a first fluid supply port 12*a* and a second fluid supply port 12*b* which are disposed substantially in parallel to one another on a side of the valve body 16. The valve body 16 also has a fluid discharge port 14 on another side thereof opposite to the side where the first and second fluid supply ports 12*a*, 12*b* are disposed. The fluid discharge port 14 discharges a mixed fluid of a fluid A and a fluid B supplied from the first fluid supply port 12*a* and the second fluid supply port 12*b*. The first ON/OFF valve section 18*a* and the second ON/OFF valve section 18*b* are substantially juxtaposed with each other on the valve body 16.

As shown in FIG. 3, the valve body 16 is composed of first and second block members 20*a*, 20*b* stacked integrally and vertically. A curved surface 22 is formed in the first block member 20*a*, and is composed of a recess curved to have a substantially semicircular cross section. The second block member 20*b* closes the recess for thereby forming an agitation chamber 24.

Figure 6:
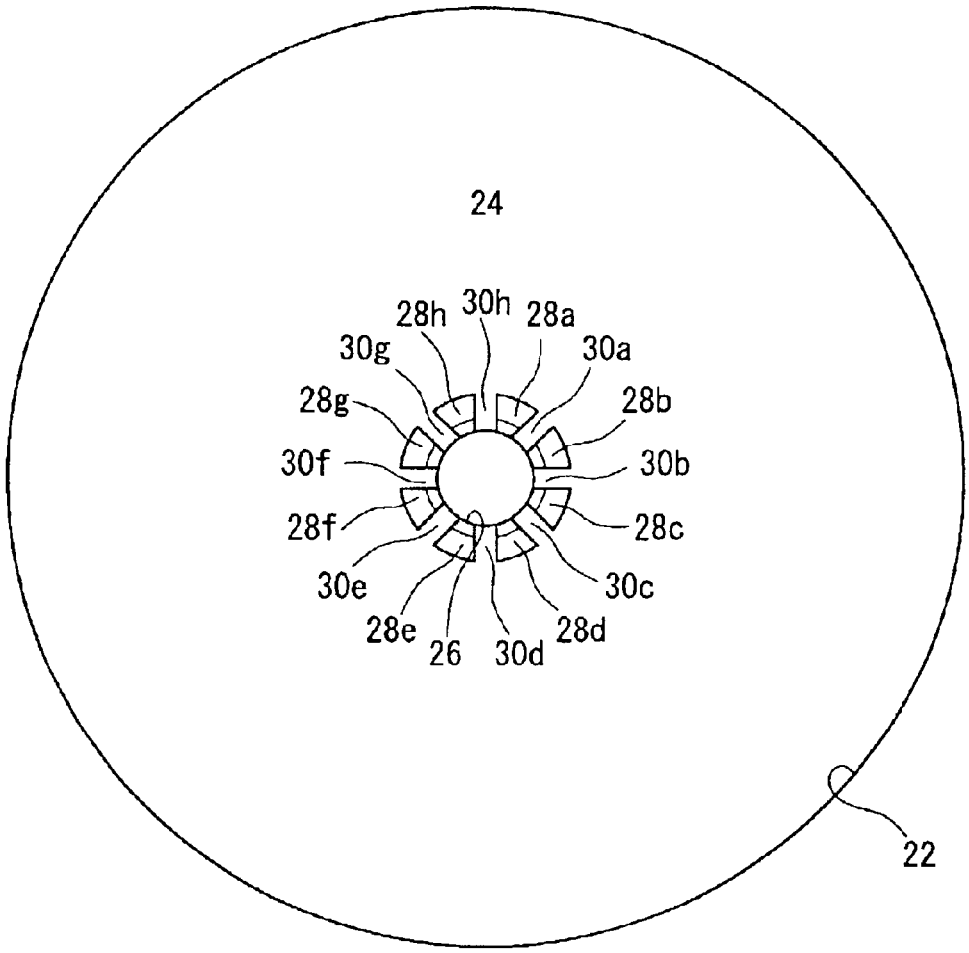
FIG. 6 is a magnified view as viewed in a direction of the arrow X shown in FIG. 3.

As shown in FIG. 6, a substantially circular hole 26, which is communicated with the fluid discharge port 14, is formed at a substantial center of the recess of the first block member 20*a*. A plurality of radial projections 28*a* to 28*h*, which are spaced from each other by predetermined angles, are formed around the hole 26. Passages 30*a* to 30*h* are formed between the adjoining radial projections 28*a* to 28*h* for gathering the mixed fluid helically swirling along the curved surface 22 of the recess of the first block member 20*a*. The mixed fluid temporarily stored under the agitation chamber 24 passes through the passages 30*a* to 30*h*. The mixed fluid flowing into the hole 26 collides against the radial projections 28*a* to 28*h* serving as obstacles. A direction in which the mixed fluid flows changes toward the passages 30*a* to 30*h*, allowing the mixed fluid to be stirred.

As shown in FIG. 3, a first helical member 32*a* and a second helical member 32*b* are inserted into holes of the first block member 20*a*. The first helical member 32*a* and the second helical member 32*b* are substantially in parallel to one another, and are spaced from each other by a predetermined distance. Fixing members 34*a*, 34*b* are disposed on an upper surface of the first block member 20*a*, and hold the first helical member 32*a* and the second helical member 32*b*. The fixing members 34*a*, 34*b* have communication holes 36 in communication with fluid passages 56 of a second housing 44*b* as described later on.

Each of the first helical member 32*a* and the second helical member 32*b* has a substantially columnar end facing the agitation chamber 24. A helical passage 38 is formed on an outer circumferential surface of each of the first helical member 32*a* and the second helical member 32*b*. The helical passage 38 is communicated with an unillustrated hole of a flange, and is helical along the circumferential surface.

Figure 4:
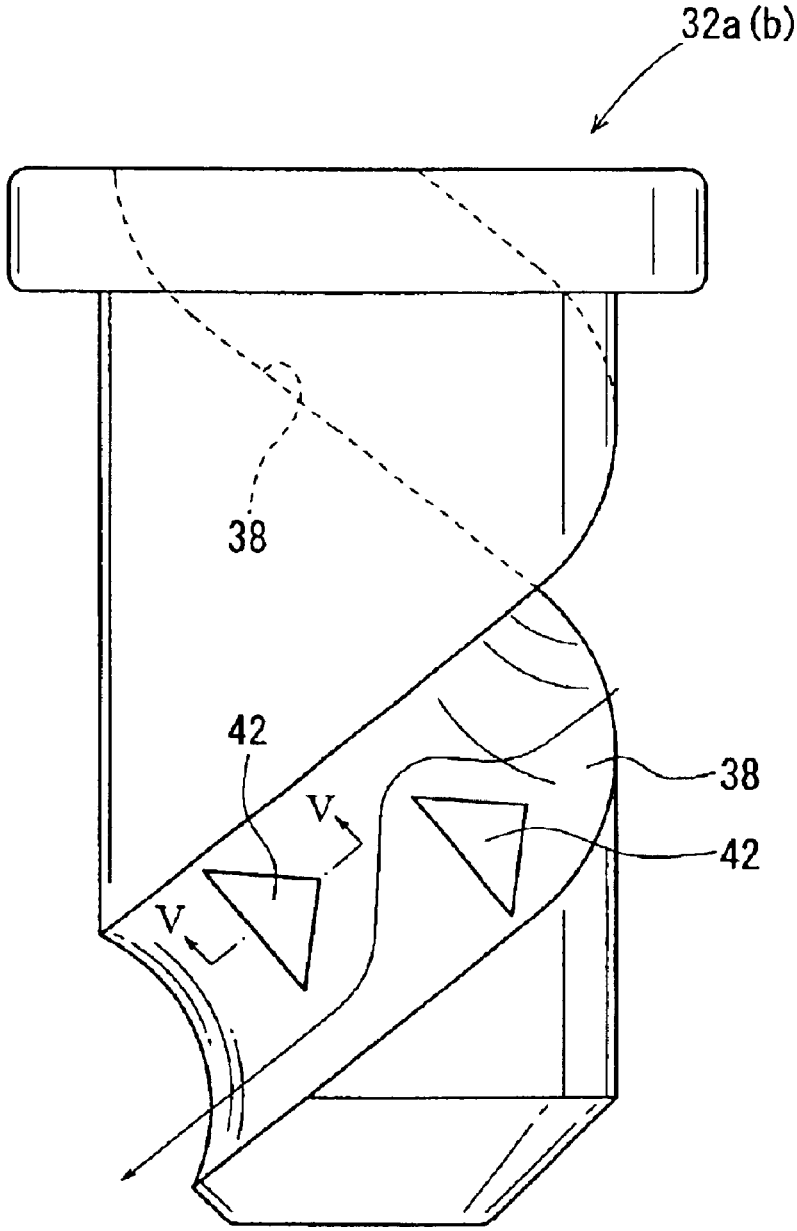
FIG. 4 is a magnified front view illustrating a helical passage of a helical member.
Figure 5:
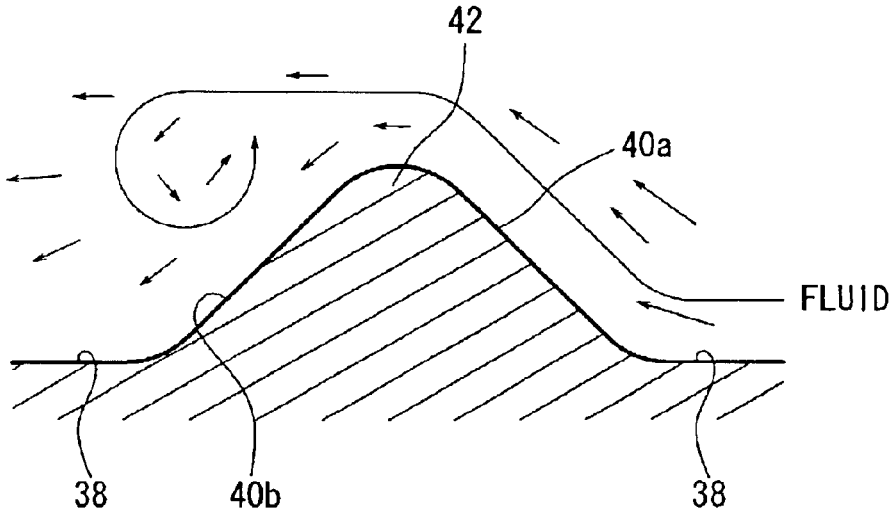
FIG. 5 is a magnified vertical sectional view taken along a line V—V shown in FIG. 4.

As shown in FIGS. 4 and 5, the helical passage 38 has a plurality of projections 42 spaced from each other by predetermined distances. The projection 42 is substantially triangular as viewed in a top view, and has a vertical cross section of a bulge shape including first and second inclined surfaces 40*a*, 40*b*. The plurality of projections 42 are alternately deviated toward one and the other widthwise sides of the helical passage 38 (in the direction substantially perpendicular to the axis of the helical passage 38) (see FIG. 4).

The helical passage 38 has a terminal end formed at the end of the first helical member 32*a* facing the agitation chamber 24. The terminal end of the helical passage 38 is opposite to the curved surface 22 of the agitation chamber 24 in which the second helical member 32*b* is disposed. The fluid flowing along the helical passage 38 does not fall vertically downwardly. Rather, the fluid is jetted toward the opposite curved surface 22 of the agitation chamber 24 (see broken lines in FIG. 3).

The first ON/OFF valve section 18*a* and the second ON/OFF valve section 18*b* which are juxtaposed with each other on the valve body 16 are constituted in the same way. In the following description, the first ON/OFF valve section 18*a* will be explained in detail below. Components of the second ON/OFF valve section 18*b* are designated by the same reference numerals, explanation of which will be omitted.

As shown in FIG. 3, the first ON/OFF valve section 18*a* includes a first housing 44*a*, a second housing 44*b*, and a bonnet 46 which are connected integrally, and a piston 50 which is arranged in a chamber 48 closed by the first housing 44*a* and the bonnet 46 and which is displaceable vertically. A seal member 52 is installed to the connecting portion between the first housing 44*a* and the bonnet 46, and seals the chamber 48 in an airtight way.

A diaphragm 58 is screwed into an axial end of the piston 50. The diaphragm 58 is seated on a seat section 54 of the second housing 44*b* for thereby opening/closing a fluid passage 56 extending under the seat section 54. The diaphragm 58 is composed of a central thick-walled portion and a thin-walled portion which is formed together with and around the thick-walled portion.

A diaphragm chamber 60 is formed under the diaphragm 58, and is communicated with a first fluid supply port 12*a* via an unillustrated passage. The diaphragm 58 is seated on the seat section 54 to thereby block the communication between the diaphragm chamber 60 and the fluid passage 56. By contrast, the diaphragm 58 moves upward away from the seat section 54 to thereby communicate the diaphragm chamber 60 and the fluid passage 56 with each other. Then, the fluid is supplied to the diaphragm chamber 60 and flows toward the fluid passage 56.

Therefore, when the pilot chamber 62 is supplied with the pilot pressure moving the piston 50 and the diaphragm 58 integrally and upwardly away from the seat section 54, the fluid is introduced from the first fluid supply port 12*a*, and flows along the helical passage 38 of the first helical member 32*a* via the unillustrated communicating passage, the diaphragm chamber 60, the fluid passage 56 and the communication hole 36 of the fixing member 34*a*.

An O-ring 64 and a packing 66 are installed to annular grooves on the outer circumferential surface of the piston 50. First and second protecting members 68, 70 are installed to the piston 50, and protect the thin-walled portion of the diaphragm 58.

Figure 7:
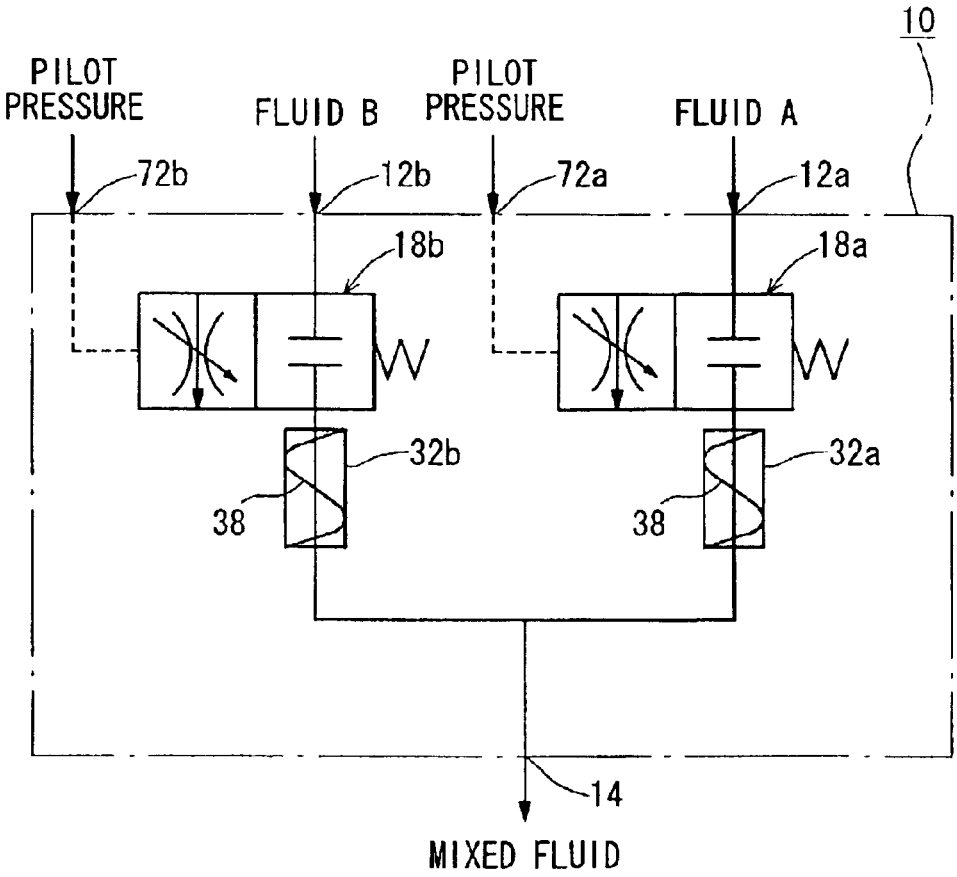
FIG. 7 is a diagram illustrating a circuit arrangement of the mixing valve shown in FIG. 1.
Figure 8:
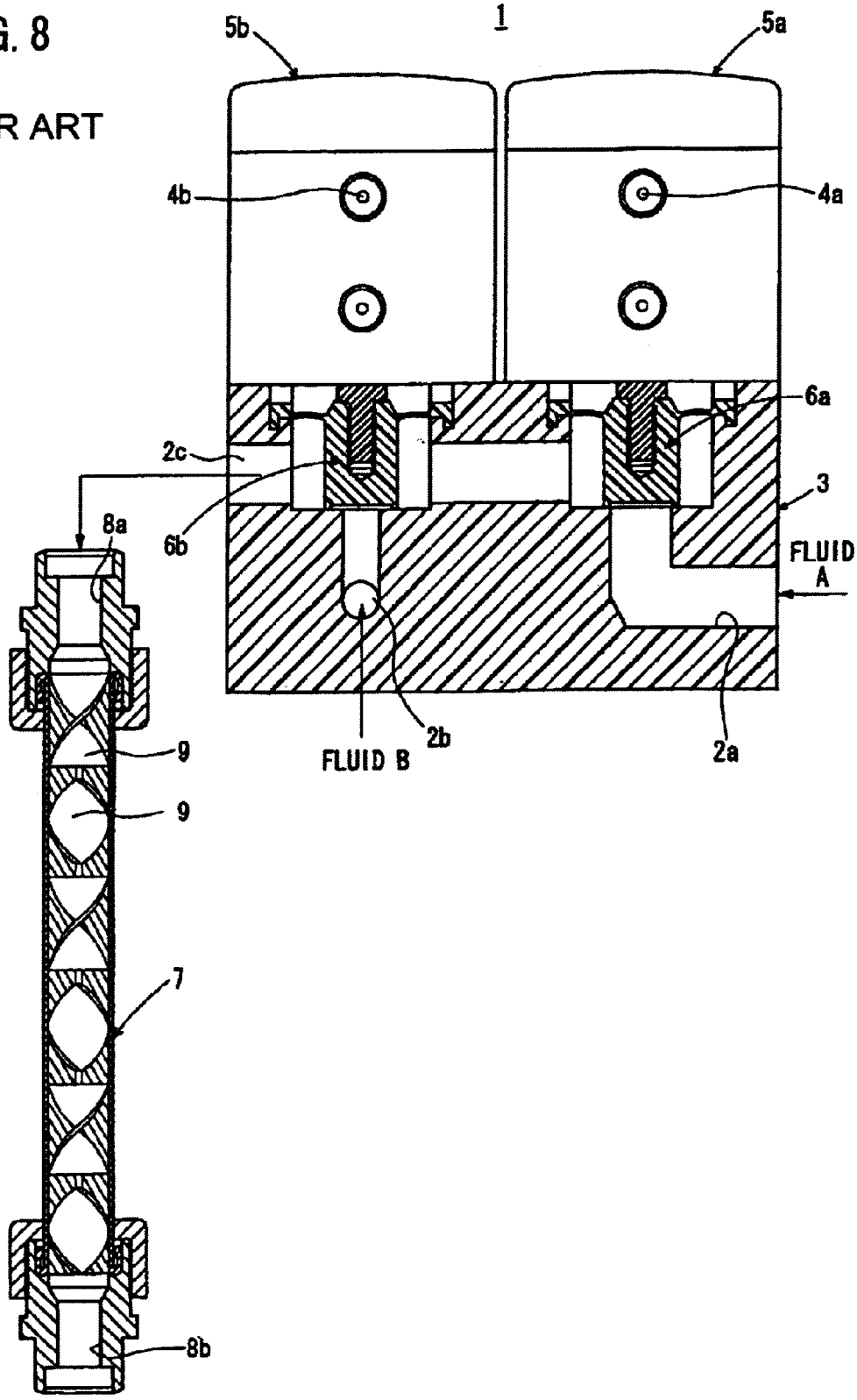
FIG. 8 PRIOR ART
FIG. 8 is a vertical sectional view illustrating a conventional mixing valve and an agitator connected downstream of the mixing valve.
Figure 9:
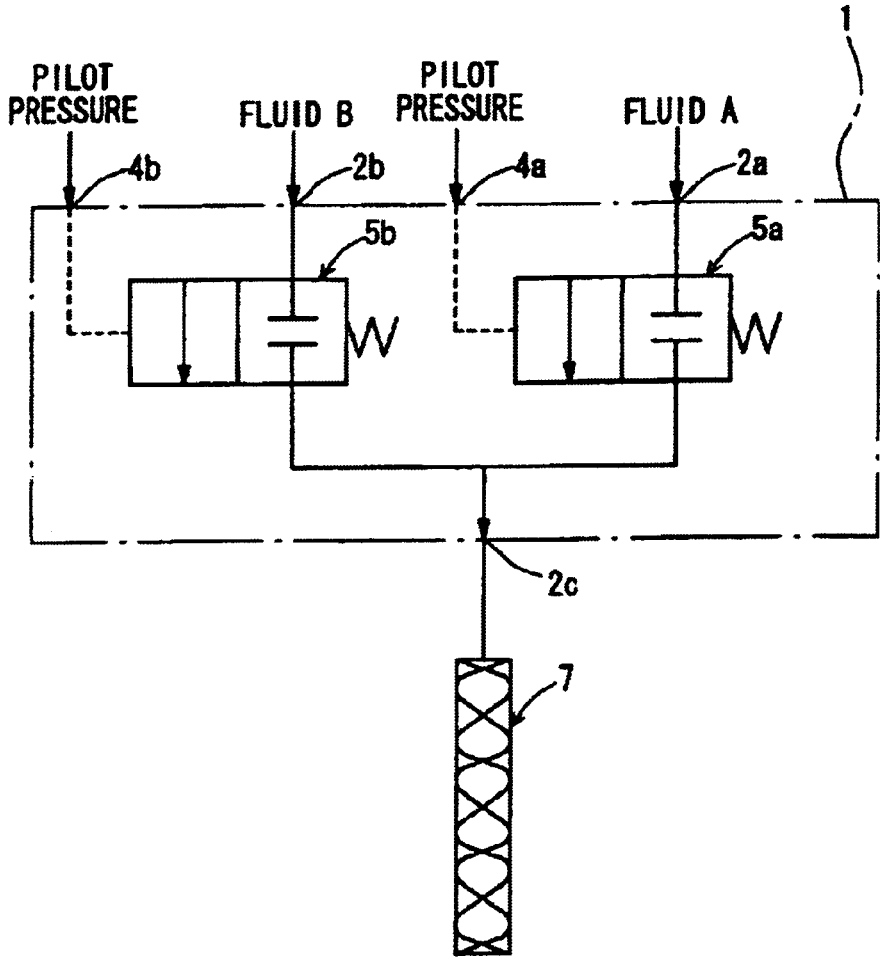
FIG. 9 PRIOR ART
FIG. 9 is a diagram illustrating a circuit arrangement of the mixing valve and the agitator shown in FIG. 8.

The diaphragm 58 closes the pilot chamber 62 formed under the flange of the piston 50 in an airtight way. The pressure fluid is supplied into the pilot chamber 62 via pilot ports 72*a*, 72*b* (see FIGS. 1, 2, and 7) communicating with the pilot chamber 62. The pressure fluid acts on the flange formed above the piston 50 for pressing the piston 50 upward.

A pair of spring members 74*a*, 74*b* having different diameters are provided in the chamber 48. Each of the pair of spring members 74*a*, 74*b* has an end fastened to the piston 50 and the other end fastened to the annular step of the bonnet 46. The piston 50 and the diaphragm 58 are always pressed downwardly by the spring force of the spring members 74*a*, 74*b*. Therefore, when the pilot chamber 62 is supplied with the pilot pressure moving the piston 50 upwardly against the spring force of the spring members 74*a*, 74*b*, the diaphragm 58 is spaced from the seat section 54 to thereby make a switch from closing a valve to opening the valve.

The bonnet 46 has an adjusting screw member (flow rate-adjusting means) 76 allowing an end thereof to contact the piston 50 for thereby regulating a displacement amount of the piston 50. A knob 78 is provided at another end of the adjusting screw member 76. The adjusting screw member 76 has a male screw screwed into a female screw of a holding member 80 held by the bonnet 46. The knob 78 is gripped to screw the adjusting screw member 76 for adjusting the vertical displacement amount. Further, the adjusting screw member 76 is fixed by a lock nut 82 provided on the upper surface of the bonnet 46.

A first damper member 84 is installed to the bonnet 46, and a second damper member 86 is installed to the first housing 44*a*. The first damper member 84 buffers the shock generated when the piston 50 moves upward and contacts the bonnet 46. The second damper member 86 buffers the shock generated when the piston 50 moves downward and contacts the first housing 44*a*.

The mixing valve 10 according to the embodiment of the present invention is basically constructed as described above. Next, its operation, function, and effect will be explained.

The first fluid supply port 12*a* is supplied with the fluid A from an unillustrated first storage source and the second fluid supply port 12*b* is supplied with the fluid B from an unillustrated second storage source (see FIG. 7) by using unillustrated tube joints, tubes or the like. An unillustrated compressed air supply source is connected to the pilot ports 72*a*, 72*b* so that a directional control valve (not shown) may be switched to supply the pilot pressure.

The fluid A and the fluid B are supplied from the first fluid supply port 12*a* and the second fluid supply port 12*b* into the diaphragm chambers 60, 60 of the first and second ON/OFF valve sections 18*a*, 18*b* through the unillustrated communicating passages. The diaphragms 58, 58 of the first and second ON/OFF valve sections 18*a*, 18*b* are seated on the seat sections 54, 54 to close the valve. Therefore, the fluids do not flow along the fluid passages 56, 56 extending under the seat sections 54, 54.

The directional control valve is switched to supply the pilot pressure from the unillustrated compressed air supply source into the pilot chambers 62, 62 of the first and second ON/OFF valve sections 18*a*, 18*b*. The pilot chambers 62, 62 are supplied with the pilot pressure moving upwardly the pistons 50, 50 of the first and second ON/OFF valve sections 18*a*, 18*b*. The diaphragms 58, 58 are displaced together with the pistons 50, 50 to thereby open the valve.

When the displacement amounts of the pistons 50, 50 are previously set by using the adjusting screw members 76, 76, the spacing distances between the diaphragms 58, 58 and the seat sections 54, 54 are adjusted to regulate the flow rates of the fluids flowing toward the fluid passages 56, 56 thereby.

When the first and second ON/OFF valve sections 18*a*, 18*b* are opened, the fluid A and the fluid B, which are supplied to the diaphragm chambers 60, 60 respectively, flow along the fluid passages 56, 56 extending under the seat sections 54, 54 and the communication holes 36, 36 of the fixing members 34*a*, 34*b*. Further, the fluid A and the fluid B flow along the helical passages 38, 38 via the unillustrated holes formed through the flanges of the first and second helical members 32*a*, 32*b*. The fluid A and the fluid B flow along the helical passages 38, 38 of the first and second helical members 32*a*, 32*b*, and thus the flow velocities are accelerated.

When the fluid A and the fluid B flow along the helical passages 38, 38, the fluid A and the fluid B flow upwardly along the first inclined surfaces 40*a* of the projections 42 each having the bulge-shaped vertical cross section of the helical passages 38, 38 as shown in FIG. 5, and then the fluid A and the fluid B flow downwardly. The fluid A and the fluid B abut against the second inclined surfaces 40*b* to turn in the direction of the arrows, generating vortex flows. Because the vortex flows or turbulences are generated, the fluid A and the fluid B do not generate any liquid pool in the helical passages 38 of the first and second helical members 32*a*, 32*b*.

The fluid A reaches the terminal end of the helical passage 38 of the first helical member 32*a*, and is jetted toward the opposite curved surface 22 of the agitation chamber 24 in which the second helical member 32*b* is disposed. The fluid A, which has abutted against the curved surface 22, once flows upwardly along the curved surface 22, and then the fluid A flows downwardly while making turn along the curved surface 22.

Similarly, the fluid B reaches the terminal end of the helical passage 38 of the second helical member 32*b*, and is jetted toward the opposite curved surface 22 of the agitation chamber 24 in which the first helical member 32*a* is disposed. The fluid B, which has abutted against the curved surface 22, once flows upwardly along the curved surface 22, and then the fluid B flows downwardly while making turn along the curved surface 22.

As described above, the fluid A and the fluid B are jetted from the terminal ends of the helical passages 38 at angles at which they intersect toward the curved agitation chamber 24. The fluid A and the fluid B flow helically downwardly in mutually opposite directions of the flowing and turning directions respectively (see broken lines in FIG. 3). Then, the turning flows, in which the flow directions are opposite to one another, are generated in the agitation chamber 24 by the fluid A and the fluid B. Further, the cyclone effect is generated by the centrifugal force applied to each of the fluid A and the fluid B. The cyclone effect is exerted on the fluid A and the fluid B as described above, and thus the fluid A and the fluid B are mixed with each other efficiently and uniformly to provide the mixed fluid.

The mixed fluid helically flows downwardly while making turn along the curved surface 22 of the agitation chamber 24, and flows into the hole 26 formed at the bottom center of the agitation chamber 24. The mixed fluid is derived to an unillustrated storage source such as a tank via the fluid discharge port 14 communicating with the hole 26.

When the mixed fluid flows into the hole 26, the radial projections 28*a* to 28*h* around the hole 26 serve as obstacles. The mixed fluid collides against the radial projections 28*a* to 28*h*. The direction in which the mixed fluid flows changes toward the slit-shaped passages 30*a* to 30*h* which are formed between the adjoining radial projections 28*a* to 28*h*. Accordingly, the mixed fluid is further agitated so that the mixed state of the mixed fluid may be further made uniform.

In the embodiment of the present invention, the fluid A and the fluid B are jetted from the helical passages 38, and are efficiently mixed by the cyclone effect in which the fluid A and the fluid B jetted from the helical passages 38 are turned along the curved surface 22 of the agitation chamber 24. Consequently, the mixed state can be made uniform.

Further, the embodiment of the present invention does not require the conventional agitator 7. Therefore, the installation space is narrowed, enabling the space to be effectively used.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A mixing valve for mixing a plurality of fluids supplied from a plurality of fluid supply ports, said mixing valve comprising:

a valve body which has an agitation chamber formed therein; and a plurality of helical members which are disposed in said valve body in a number corresponding to a number of said fluid supply ports, said fluid supply ports communicating respectively with each of said helical members, wherein said helical members are disposed non-coaxially parallel to each other with ends facing said agitation chamber, and wherein helical passages are formed on outer circumferential surfaces of each of said plurality of helical members, said fluids being supplied separately from said fluid supply ports to each of said helical members, said fluids passing through said helical passages respectively prior to being introduced to said agitation chamber.

2. The mixing valve according to claim 1, wherein said helical passage have a plurality of projections spaced from each other by predetermined distances along said helical passages.

3. The mixing valve according to claim 2, wherein said projections are substantially triangular as viewed in a top view, said projections having a vertical cross section of a bulge shape.

4. The mixing valve according to claim 2, wherein said projections are alternately deviated on one and the other widthwise sides of said helical passage.

5. The mixing valve according to claim 1, wherein each of said helical passages has a terminal end opposite to a curved surface of said agitation chamber, said curved surface having a substantially semicircular cross section, said fluids flowing down out of said helical passages so that said fluids abut against said curved surface and helically turn along said curved surface.

6. The mixing valve according to claim 1, wherein said plurality of fluids flow out of terminal ends of said helical passages at angles at which said plurality of fluids intersect with each other.

7. The mixing valve according to claim 1, wherein said agitation chamber has a hole at a lower portion thereof in communication with a fluid discharge port, and radial projections and passages are formed around said hole, said radial projections extending radially and being spaced from each other by predetermined angles, and said passages being communicated with said hole and being disposed between said adjoining radial projections.

8. The mixing valve according to claim 1, further comprising ON/OFF valve sections to open/close fluid passages for providing communication between said fluid supply ports and said agitation chamber, said ON/OFF valve sections having flow rate-adjusting mechanisms for adjusting flow rates of said fluids flowing through said fluid passages.

9. The mixing valve according to claim 1, wherein said agitation chamber comprises a convex surface, said convex surface having a substantially semicircular cross section.

10. A mixing valve for mixing a plurality of fluids supplied from a plurality of fluid supply ports, said mixing valve comprising:

a valve body which has an agitation chamber formed therein; and a plurality of helical members which are disposed in said valve body in a number corresponding to a number of said fluid supply ports, which have ends facing said agitation chamber and which have helical passages formed on outer circumferential surfaces of said plurality of helical members, said fluids being supplied from said fluid supply ports and passing through said helical passages, wherein said helical passages have a plurality of projections spaced from each other by predetermined distances along said helical passages, said projections being substantially triangular as viewed in a top view, said projections having a vertical cross section of a bulge shape.

11. The mixing valve according to claim 10, wherein said projections are alternately deviated on one and the other widthwise sides of said helical passage.

12. The mixing valve according to claim 10, wherein each of said helical passages has a terminal end opposite to a curved surface of said agitation chamber, said curved surface having a substantially semicircular cross section, said fluids flowing down out of said helical passages so that said fluids abut against said curved surface and helically turn along said curved surface.

13. The mixing valve according to claim 10, wherein said plurality of fluids flow out of terminal ends of said helical passages at angles at which said plurality of fluids intersect with each other.

14. The mixing valve according to claim 10, wherein said agitation chamber has a hole at a lower portion thereof in communication with a fluid discharge port, and radial projections and passages are formed around said hole, said radial projections extending radially and being spaced from each other by predetermined angles, and said passage being communicated with said hole and being disposed between said adjoining radial projections.

15. The mixing valve according to claim 10, further comprising ON/OFF valve sections to open/close fluid passages for providing communication between said fluid supply ports and said agitation chamber, said ON/OFF valve sections having flow rate-adjusting mechanisms for adjusting flow rates of said fluids flowing through said fluid passages.

16. The mixing valve according to claim 10, wherein said agitation chamber comprises a convex surface, said convex surface having a substantially semicircular cross section.

17. A mixing valve for mixing a plurality of fluids supplied from a plurality of fluid supply ports, said mixing valve comprising:

a valve body which has an agitation chamber formed therein; and a plurality of helical members which are disposed in said valve body in a number corresponding to a number of said fluid supply ports, which have ends facing said agitation chamber and which have helical passages formed on outer circumferential surfaces of said plurality of helical members, said fluids being supplied from said fluid supply ports and passing through said helical passages, wherein said helical passages have a plurality of projections spaced from each other by predetermined distances along said helical passages, said projections being alternately deviated on one and the other widthwise sides of said helical passage.

18. The mixing valve according to claim 17, wherein said projections are substantially triangular as viewed in a top view, said projections having a vertical cross section of a bulge shape.

19. The mixing valve according to claim 17, wherein each of said helical passages has a terminal end opposite to a curved surface of said agitation chamber, said curved surface having a substantially semicircular cross section, said fluids flowing down out of said helical passages so that said fluids abut against said curved surface and helically turn along said curved surface.

20. The mixing valve according to claim 17, wherein said plurality of fluids flow out of terminal ends of said helical passages at angles at which said plurality of fluids intersect with each other.

21. The mixing valve according to claim 17, wherein said agitation chamber has a hole at a lower portion thereof in communication with a fluid discharge port, and radial projections and passages are formed around said hole, said radial projections extending radially and being spaced from each other by predetermined angles, and said passages being communicated with said hole and being disposed between said adjoining radial projections.

22. The mixing valve according to claim 17, further comprising ON/OFF valve sections to open/close fluid passages for providing communication between said fluid supply ports and said agitation chamber, said ON/OFF valve sections having flow rate-adjusting mechanisms for adjusting flow rates of said fluids flowing through said fluid passages.

23. The mixing valve according to claim 17, wherein said agitation chamber comprises a convex surface, said convex surface having a substantially semicircular cross section.

24. A mixing valve for mixing a plurality of fluids supplied from a plurality of fluid supply ports, said mixing valve comprising:

a valve body which has an agitation chamber formed therein; and a plurality of helical members which are disposed in said valve body in a number corresponding to a number of said fluid supply ports, which have ends facing said agitation chamber and which have helical passages formed on outer circumferential surfaces of said plurality of helical members, said fluids being supplied from said fluid supply ports and passing through said helical passages, wherein said agitation chamber has a bole at a lower portion thereof in communication with a fluid discharge port, and radial projections and passages are formed around said hole, said radial projections extending radially and being spaced from each other by predetermined angles, and said passages being communicated with said hole and being disposed between said adjoining radial projections.

25. The mixing valve according to claim 24, wherein said helical passages have a plurality of projections spaced from each other by predetermined distances along said helical passages.

26. The mixing valve according to claim 25, wherein said projections are substantially triangular as viewed in a top view, said projections having a vertical cross section of a bulge shape.

27. The mixing valve according to claim 25, wherein said projections are alternately deviated on one and the other widthwise sides of said helical passage.

28. The mixing valve according to claim 24, wherein each of said helical passages has a terminal end opposite to a curved surface of said agitation chamber, said curved surface having a substantially semicircular cross section, said fluids flowing down out of said helical passages so that said fluids abut against said curved surface and helically turn along said curved surface.

29. The mixing valve according to claim 24, wherein said plurality of fluids flow out of terminal ends of said helical passages at angles at which said plurality of fluids intersect with each other.

30. The mixing valve according to claim 24, further comprising ON/OFF valve sections to open/close fluid passages for providing communication between said fluid supply ports and said agitation chamber, said ON/OFF valve sections having flow rate-adjusting mechanisms for adjusting flow rates of said fluids flowing through said fluid passages.

31. The mixing valve according to claim 24, wherein said agitation chamber comprises a convex surface, said convex surface having a substantially semicircular cross section.

* * * * *